US010852111B1

(12) United States Patent
Recchia et al.

(10) Patent No.: US 10,852,111 B1
(45) Date of Patent: Dec. 1, 2020

(54) PRESSURE RELIEF FINS FOR IMPROVED ROLL CONTROL OF PRECISION PROJECTILES

(71) Applicant: U.S. Government as Represented by the Secretary of the Army, Dover, NJ (US)

(72) Inventors: Thomas Recchia, Succasunna, NJ (US); Yin Chen, West Milford, NJ (US); Mitchell Stolk, Kearny, NJ (US); David Hosier, Lafayette, NJ (US); Sarah Hunt, Mount Arlington, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 245 days.

(21) Appl. No.: 15/935,278

(22) Filed: Mar. 26, 2018

Related U.S. Application Data

(60) Provisional application No. 62/481,335, filed on Apr. 4, 2017.

(51) Int. Cl.
*F42B 10/06* (2006.01)
*F42B 10/64* (2006.01)

(52) U.S. Cl.
CPC ..... *F42B 10/06* (2013.01); *F42B 10/64* (2013.01)

(58) Field of Classification Search
CPC ..... F42B 10/04; F42B 10/06; F42B 10/064; B64C 21/02; B64C 21/025; B64C 2230/20
See application file for complete search history.

(56) References Cited

U.S. PATENT DOCUMENTS 1,613,348 A * 1/1927 Falkenthal ..... B64C 21/02 244/198
1,876,635 A * 9/1932 Deutscher ..... B64C 21/02 244/198
2,163,655 A * 6/1939 Zimmerman ..... B64C 21/02 244/199.1
2,926,870 A 11/1956 Schwartz
3,392,934 A * 7/1968 Daniels ..... F42B 10/06 244/3.23
4,392,621 A * 7/1983 Viets ..... B64C 9/38 137/829

(Continued)

OTHER PUBLICATIONS

Blair, Dillon, Watson, Experimental Study of Tail-Span Effects on a Canard-Controlled Missile, Journal of Spacecraft and Rockets, Sep. 1993, 635-640, vol. 30 No. 5, American Institute of Aeronautics and Astronautics, Reston, VA, US.

(Continued)

*Primary Examiner* — Joseph W Sanderson
(74) *Attorney, Agent, or Firm* — John P. DiScala

(57) ABSTRACT

Pressure relief holes are sized and positioned on each fin of a projectile to allow high pressure from one side of the fin due to canard and fin interaction to bleed to a low pressure area on the opposite side of the fin. The location of the pressure relief holes target pressure differences due to canard roll control downwash while not affecting pressure differences due to projectile attitude. The fin planform area remains small enough to meet packaging and fire requirements for this type of munition and large enough to aerodynamically stabilize the airframe thereby enabling a more robust pitch and yaw autopilot design.

10 Claims, 2 Drawing Sheets

(56) References Cited

U.S. PATENT DOCUMENTS 5,167,387 A * 12/1992 Hartwich ..... B64C 21/025 244/200
5,622,335 A * 4/1997 Trouillot ..... F42B 10/06 102/385
6,286,789 B1 * 9/2001 Shimovetz ..... B64C 3/54 244/201
6,612,524 B2 * 9/2003 Billman ..... B64C 23/06 244/130
6,866,233 B2 * 3/2005 Patel ..... B64C 21/025 244/204
7,070,144 B1 * 7/2006 DiCocco ..... B64C 5/12 244/3.21
7,718,937 B1 * 5/2010 Dunn ..... F42B 10/64 244/3.11
7,800,032 B1 * 9/2010 Facciano ..... F42B 10/64 244/3.24
8,110,785 B2 * 2/2012 Rastegar ..... F16H 25/02 244/3.24
8,193,476 B2 * 6/2012 Olden ..... F42B 10/668 102/377
8,294,072 B2 * 10/2012 Geswender ..... F42B 10/16 244/3.24
2003/0132351 A1 * 7/2003 Billman ..... B64C 23/06 244/199.1
2004/0129839 A1 * 7/2004 Patel ..... B64C 21/025 244/204
2010/0032516 A1 * 2/2010 Olden ..... F42B 10/64 244/3.27
2010/0219285 A1 * 9/2010 Facciano ..... F42B 10/143 244/3.25
2010/0275805 A1 * 11/2010 Rastegar ..... F16H 25/02 102/501
2016/0009374 A1 * 1/2016 Glezer ..... G05D 7/01 244/99.13

OTHER PUBLICATIONS

Blair, Dillon, Watson, Experimental Study of Tail-Span Effects on a Generic Canard-Controlled Missile; J30th Aerospace Sciences Meeting and Exhibit, Jan. 1992, American Institute of Aeronautics and Astronautics, Reston, VA, US.

Despirito, Vaughn, Washington, Numerical Investigation of Aerodynamics of Canard-Controlled Missile Using Planar and Grid Tail Fins, Part I: Supersonic Flow, Sep. 2002, ARL-TR-2848, Army Research Lab, Aberdeen Proving Ground, MD, US.

Despirito, Vaughn, Washington, Numerical Investigation of Aerodynamics of Canard-Controlled Missile Using Planar and Grid Tail Fins, Part II: Subsonic and Transonic Flow, Mar. 2004, ARL-TR-3162, Army Research Lab, Aberdeen Proving Ground, MD, US.

Blair, An Experimental Wind-Tunnel Investigation of a Ram-Air-Spoiler Roll-Control Device on a Forward-Control Missile at Supersonic Speeds, Dec. 1978, NASA Technical Paper 1353, National Aeronautics and Space Administration, Washington, DC, US.

* cited by examiner

PRESSURE RELIEF FINS FOR IMPROVED ROLL CONTROL OF PRECISION PROJECTILES

CROSS-REFERENCE TO RELATED APPLICATIONS

This application claims the benefit under 35 USC § 119(e) of U.S. provisional patent application 62/481,335 filed on Apr. 4, 2017.

STATEMENT OF GOVERNMENT INTEREST

The inventions described herein may be manufactured, used and licensed by or for the United States Government.

BACKGROUND OF THE INVENTION

The invention relates in general to precision guided weapons and in particular to precision guided weapons with deflectable canards.

Precision munitions that use deflectable canards to create maneuvers experience a reduction in their control authority in the roll direction due to downwash effects on their fins. Prior solutions to this problem include using decoupled bases/fin hubs, very large fins to overwhelm the effect, using deflectable tail fins instead of deflectable canards and using very small fins to reduce the interaction effects and thereby essentially rely solely on canards for active control of the missile.

However, the previous efforts are not suitable for certain precision guided weapons. Decoupled bases are more mechanically complex. Deflectable tail fins require control electronics collocated at the rear of the projectile or lengthy communication paths which may not be feasible for all weapons. Enlarging the fins necessarily creates a larger cross sectional diameter of the weapon which may not be compatible with desired packaging and gun tubes requirements. Finally, reducing the size of the fins to interaction effects may reduce the level of control to an unacceptable level for certain munitions.

Specifically, there exists a need for a precision guided weapon which can mitigate roll control issues caused by deflectable canards while maintaining canard control of the weapon without drastically changing the size of either the canard or the fin.

SUMMARY OF INVENTION

One aspect of the invention is a precision guided weapon having rear fins with pressure relief holes sized and positioned to allow high pressure from one side of the fin due to canard and fin interaction to bleed to a low pressure area on the opposite side of the fin.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A precision guided munition with fins comprising pressure relief holes allows for relief of pressure differences due to downwash which significantly reduces the canard/fin interference effects. Accordingly, roll control of the projectile is restored. The precision guided munition is an easily controlled aerodynamically stable projectile configuration that is packageable and has a significant reduction in the canard/fin interaction, which increases the roll control authority of the projectile. Advantageously, the pressure relief holes may be a modification to standard fin platforms currently in use thereby negating the need for further modifications to the projectile or its weapon platform. Additionally, the fin planform area which contributes to projectile stability is not altered.

Figure 1:
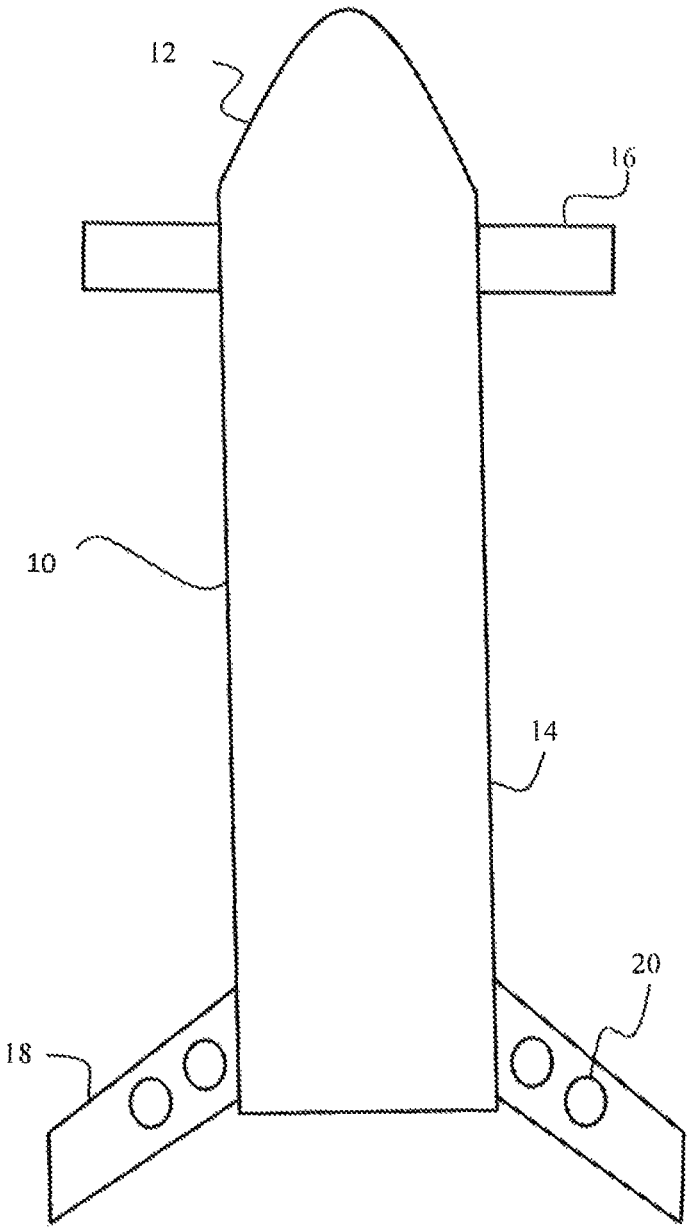
FIG. 1 is a side view of a weapon with fins comprising pressure relief holes, in accordance with an illustrative embodiment of the invention.

FIG. 1 is a side view of a munition with fins comprising pressure relief holes, in accordance with an illustrative embodiment of the invention. While throughout this specification, the projectile is described in terms of a munition, the projectile is not limited to a munition. The projectile may be a non-military projectile and throughout this specification, the terms munition and projectile are used interchangeably. In the embodiment shown, the projectile 10 is artillery mortar projectile. For example, the projectile 10 may be a 120 mm mortar projectile. However, the projectile 10 is not limited to artillery projectiles and may be any projectile 10, which experiences downwash due to canard and fin interaction. Further, the projectile is not limited to airborne projectiles and may be any projectile which is configured to travel through a fluid medium including fluids in the gaseous or liquid state or some combination of both.

The projectile 10 comprises a nose 12, a body 14, a canard set 16 and a fin set comprising a plurality of fins 18. The nose 12 is the front and round part of the projectile and is the first part of the projectile to touch the incoming air stream. The body 14 of the projectile contains the payload and guidance electronics. The canard set 16 controls projectile flight by deflecting in a coordinated way to produce aerodynamic moments about the projectile center of gravity. The fin set provides stability to the projectile. Each fin 18 of the fin set comprises one or more pressure relief holes 20.

Figure 2:
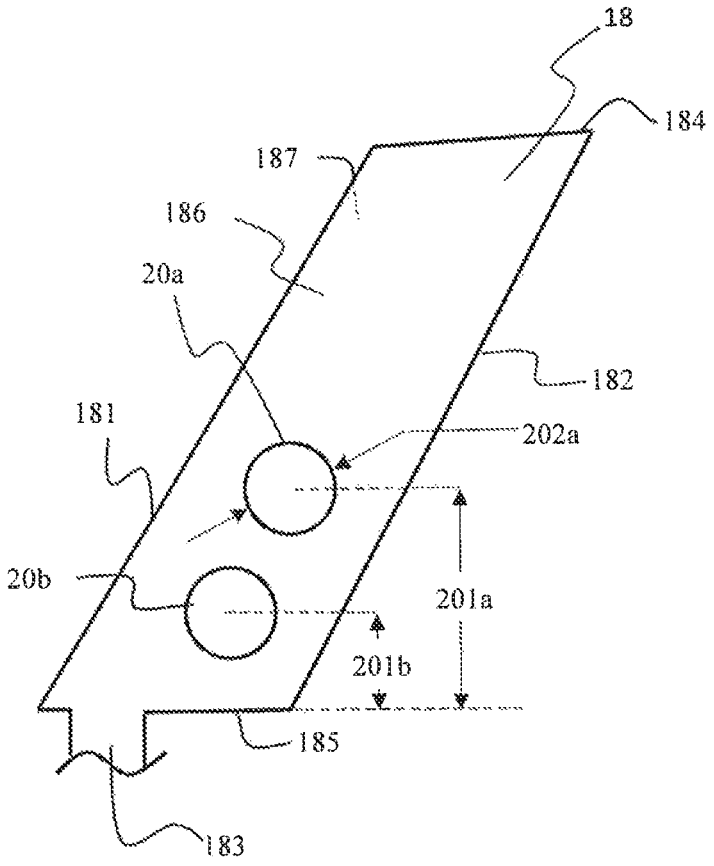
FIG. 2 is a side view of a fin with pressure relief holes, in accordance with an illustrative embodiment of the invention.

FIG. 2 is a side view of a fin with pressure relief holes, in accordance with an illustrative embodiment of the invention. Each fin 18 of the fin set comprises a leading edge 181 which is the first contact with incoming air stream, a trailing edge 182 which is the last contact with outgoing airstream, an attachment point of fin to projectile body 183, one or more pressure relief holes 20*a,b* defined by a diameter 202*a* and a radial location 201*a,b*, a tip chord 184 of the fin 18 (edge of fin 18 at the distal end of the fin 18 most outboard from centerline of projectile 10) and a root chord 185 of fin 18 (edge of fin 18 located at the proximate end of the fin 18 at the surface of the projectile 10).

Each of the pressure relief holes 20 are defined by the fin 18 and extend from a top surface 186 of the fin 18 to a bottom surface 187 of the fin 18. The pressure relief holes 20 are sized and positioned on each fin to allow high pressure from one side of the fin due to canard and fin interaction to bleed to a low pressure area on the opposite side of the fin. The location of the pressure relief holes 20 target pressure differences due to canard roll control downwash while not affecting pressure differences due to projectile attitude. Incorporation of the pressure relief holes 20 to alleviate downwash effects allows the fin planform area to remain small enough to meet packaging and fire requirements for this type of munition and large enough to aerodynamically stabilize the airframe thereby enabling a more robust pitch and yaw autopilot design.

The inventors discovered the aerodynamic moments generated by the canard-fin interactions are created by localized pressure of the airstream pushing normal to the fin surface. When the pressure on the fins is integrated over the fin planform area, the resultant force is almost always located at a distance from the principle axes of projectile. This creates a force and a moment about the projectile center of gravity. For projectile control, the moments generated are of critical importance. By managing the pressure distribution with pressure relief holes 20, particularly reducing the pressure differences in the localized areas where the canard-fin interactions are largest, the overall behavior of the projectile can be tailored to meet design specifications.

In the embodiment shown in FIG. 1 and FIG. 2, each fin comprises a first pressure relief hole 20*a* and a second pressure relief hole 20*b*. For mortar rounds of the type and dimensions shown in FIG. 1 and FIG. 2, it was discovered that the counter-roll moment produced on the fins is localized to a lower portion of the fins adjacent the root chord. Accordingly, pressure relief holes 20 were sized and dimensioned to minimize the fin surface area corresponding to this locations.

The first pressure relief hole 20*a* and the second pressure relief hole 20*b* are positioned such that their center is substantially aligned along a central longitudinal axis of the fin extending from the tip chord to the root chord. The pressure relief holes 20 have a diameter which is approximately 60% of the width of the fin at the location of the center of the pressure relief hole 20. The approximately 60% width was chosen to satisfy structural requirements while providing holes with a relatively large and contiguous cross-sectional area for pressure relief.

The first pressure relief hole 20*a* and the second pressure relief hole 20*b* have substantially the same diameter. In one embodiment, each of the first pressure relief hole 20*a* and second pressure relief hole 20*b* may be chamfered thereby creating a chamfered circumferential edge. The outer circumference of the first pressure relief hole 20*a* and the outer circumference of the second pressure relief hole 20*b* are separated a distance of approximately ⅜ of the diameter of the pressure relief holes 20.

The first pressure relief hole 20*a* and the second pressure relief hole 20*b* are positioned near the localized areas of counter-roll moment as described above. Accordingly, the first pressure relief hole 20*a* and the second pressure relief hole 20*b* are positioned substantially in a bottom portion of the fin at the proximate end of the fin near the root chord 184. In the embodiment shown in FIG. 2, the first pressure relief hole 20*a* and the second pressure relief hole 20*b* are below a central lateral axis extending from the leading edge 181 to the trailing edge 182.

Although two relatively large holes were found to be optimal for the particular embodiment shown in FIG. 1 and FIG. 2, those skilled in the art will appreciate that other configurations may prove optimal for other embodiments, including but not limited to: more holes with smaller diameters, less holes with larger diameters, different locating patterns of the holes based on instantiation of the projectile design and differently shaped holes. The defining characteristic of any of these designs would be the specific targeted location of the holes to relieve the pressure differences caused by downwash from the canards during a roll command.

Testing was performed to compare the effect of the pressure relief holes 20 on roll control authority. First, wind tunnel testing was performed on fins with no holes to confirm that the fin experienced downwash effects. Computational fluid dynamics (CFD) analysis was then performed on the fins modeled without pressure relief holes and fins modeled with pressure relief holes 20. The CFD analysis confirmed the findings from the wind tunnel hardware. The exact effects were isolated. CFD analysis was then performed on fins with pressure relief holes 20. The inventors found that with the pressure relief holes 20, approximately 40% of roll control authority was restored. Importantly, it was determined that projectile aerodynamic stability was maintained for the fins with the pressure relief holes 20.

While the invention has been described with reference to certain embodiments, numerous changes, alterations and modifications to the described embodiments are possible without departing from the spirit and scope of the invention as defined in the appended claims, and equivalents thereof.

What is claimed is:

1. A projectile comprising:

a canard set for controlling projectile flight;

a fin having one or more pressure relief holes operable during an independent controlled flight phase of the projectile, each of the one or more pressure relief holes defined by the fin and extending from a top surface to a bottom surface and allowing high pressure due to canard and fin interaction during the independent controlled flight phase from one surface of the fin to transfer to a low pressure area on an opposing side of the fin while not affecting pressure differences due to projectile attitude.

2. The projectile of claim 1 wherein the pressure relief holes are circular.

3. The projectile of claim 2 wherein the fin comprises a first pressure relief hole and a second pressure relief hole and wherein the pressure relief holes are each positioned such that their centers are aligned along a central longitudinal axis of the fin.

4. The projectile of claim 3 wherein the first pressure hole and the second pressure hole are positioned within a portion of the fin which is below a central lateral axis and at the proximate end of the fin.

5. The projectile of claim 3 wherein the first pressure relief hole and the second pressure relief hole are sized and dimensioned such that the diameter of each is 60% of a root chord length of the fin.

6. The projectile of claim 3 wherein an outer circumference of the first pressure relief hole and an outer circumference of the second pressure relief hole are separated a distance of ⅜ of the diameter of the pressure relief holes.

7. The projectile of claim 1 wherein the projectile is a mortar projectile.

8. A precision guided mortar projectile comprising:

a body housing a payload and guidance electronics;

a canard set extending radially from the body at a nose end of the projectile for controlling projectile flight;

a plurality of fins extending radially from the body at a tail end, each of the fins having a circular first pressure relief hole and a circular second pressure relief hole, each of the first pressure relief hole and the second pressure relief hole operable during an independent controlled flight phase of the projectile and defined by the fin and extending from a top surface to a bottom surface and allowing high pressure due to canard and fin interaction during the independent controlled flight phase from one surface of the fin to transfer to a low pressure area on an opposing side of the fin while not affecting pressure differences due to projectile attitude and wherein the first pressure relief hole and the second pressure relief hole are positioned on a portion of the fin which is below a central lateral axis and at the proximate end of the fin and such that their centers are substantially aligned along a central longitudinal axis of the fin.

9. The precision guided mortar projectile of claim 8 wherein the first pressure relief hole and the second pressure relief hole are sized and dimensioned such that the diameter of each is 60% of a root chord length of the fin.

10. The precision guided mortar projectile of claim 8 wherein an outer circumference of the first pressure relief hole and an outer circumference of the second pressure relief hole are separated a distance of ⅜ of the diameter of the pressure relief holes.

* * * * *